US007465253B2

(12) United States Patent
Perry et al.

(10) Patent No.: US 7,465,253 B2
(45) **Date of Patent: *Dec. 16, 2008**

(54) PROPRIOCEPTION MACHINE

(75) Inventors: Clifford R. Perry, Montesano, WA (US); Don A. Perry, Decatur, IL (US)

(73) Assignee: Perry Dynamics, Inc., Decatur, IL (US)

( * ) Notice: Subject to any disclaimer, the term of this patent is extended or adjusted under 35 U.S.C. 154(b) by 93 days.

This patent is subject to a terminal disclaimer.

(21) Appl. No.: 11/284,349

(22) Filed: Nov. 21, 2005

(65) Prior Publication Data

US 2006/0073941 A1 Apr. 6, 2006

Related U.S. Application Data

(63) Continuation of application No. 10/418,238, filed on Apr. 17, 2003, now Pat. No. 7,004,895.

(60) Provisional application No. 60/373,723, filed on Apr. 17, 2002.

(51) Int. Cl.
*A63B 22/16* (2006.01)
*A63B 23/04* (2006.01)

(52) U.S. Cl. ..... 482/51; 482/79; 482/146; 434/258; 601/26; 600/595; 273/449

(58) Field of Classification Search ..... 482/146, 482/148, 34, 51, 79; 273/449; 73/865.4; 601/23, 24, 26; 434/247, 258; 600/595
See application file for complete search history.

(56) References Cited

U.S. PATENT DOCUMENTS

| | | | | | |
|---|---|---|---|---|---|
| 3,633,918 | A | * | 1/1972 | Smiley et al. | 473/279 |
| 3,859,736 | A | * | 1/1975 | Hill et al. | 434/55 |
| 4,290,601 | A | * | 9/1981 | Mittelstadt | 472/14 |
| 4,452,447 | A | | 6/1984 | Lepley et al. | 482/79 |
| 4,491,318 | A | | 1/1985 | Francke | 482/147 |
| 4,605,220 | A | | 8/1986 | Troxel | 482/79 |
| 4,676,501 | A | * | 6/1987 | Hoagland et al. | 482/51 |
| 4,817,950 | A | | 4/1989 | Goo | 463/36 |
| 4,850,588 | A | * | 7/1989 | Desjardins et al. | 482/51 |
| 5,035,418 | A | * | 7/1991 | Harabayashi | 482/62 |
| 5,112,045 | A | * | 5/1992 | Mason et al. | 482/9 |
| 5,358,251 | A | * | 10/1994 | Ashton | 473/269 |
| 5,368,536 | A | | 11/1994 | Stodgell | 482/79 |
| 5,429,562 | A | * | 7/1995 | Milner | 482/51 |
| 5,454,774 | A | * | 10/1995 | Davis | 482/146 |
| 5,613,690 | A | * | 3/1997 | McShane et al. | 273/449 |
| 5,627,327 | A | * | 5/1997 | Zanakis | 73/862.042 |
| 5,713,794 | A | * | 2/1998 | Shimojima et al. | 463/36 |
| 5,755,652 | A | | 5/1998 | Gardner | 482/146 |
| 5,820,478 | A | * | 10/1998 | Wood et al. | 473/279 |
| 5,851,166 | A | | 12/1998 | Bernardson | 482/79 |
| 5,919,150 | A | * | 7/1999 | Zanakis | 600/595 |
| 5,941,807 | A | * | 8/1999 | Cassidy et al. | 482/146 |
| 6,063,046 | A | * | 5/2000 | Allum | 600/595 |

(Continued)

*Primary Examiner*—Victor K. Hwang
(74) *Attorney, Agent, or Firm*—Alvin T. Rockhill

(57) ABSTRACT

A proactive machine is used for assessing and improving a user's proprioception. The machine has a tilting platform upon which the user stands, a non-rotating tilting means connected to the platform for tilting the platform along a first axis and along a second axis perpendicular to the first axis, and a control means for controlling the tilting means.

20 Claims, 9 Drawing Sheets

U.S. PATENT DOCUMENTS 6,162,189 A * 12/2000 Girone et al. ..... 600/592
6,176,817 B1 * 1/2001 Carey et al. ..... 482/146
6,277,057 B1 8/2001 Hayden ..... 482/79
6,389,883 B1 * 5/2002 Berme et al. ..... 73/65.01
6,558,304 B1 * 5/2003 Bardon et al. ..... 482/147
6,663,498 B2 * 12/2003 Stipan ..... 473/279
6,774,885 B1 * 8/2004 Even-Zohar ..... 345/156
7,004,895 B2 * 2/2006 Perry et al. ..... 482/146
7,008,360 B1 * 3/2006 Smith ..... 482/146

* cited by examiner

PROPRIOCEPTION MACHINE

This is a continuation application of U.S. patent application Ser. No. 10/418,238, filed on Apr. 17, 2003, now issued as U.S. Pat. No. 7,004,895, which claims the priority of U.S. Provisional Application Ser. No. 60/373,723, filed on Apr. 17, 2002. The teachings of U.S. Pat. No. 7,004,895 are incorporated herein by reference in their entirety.

FIELD OF THE INVENTION

This invention relates to exercise and therapeutic machines. More particularly, this invention relates to machines for assessing and improving a user's proprioception.

BACKGROUND OF THE INVENTION

Proprioception is the awareness of one's own body position. Proprioception enables a person to balance while standing or walking upright. It also enables a person to consciously and unconsciously flex various muscles to strengthen joints and thereby reduce injuries. The role of proprioception in improving athletic performance in preventing joint injuries and in rehabilitation is becoming more recognized as detailed in, for example, "Refining Rehabilitation With Proprioception Training: Expediting Return To Play" by Edward R. Laskowski et al., The Physician and Sportsmedicine, Vol. 25,No. 10.

There are many machines that exercise the lower body. For example, ankle exercisers are disclosed in Lepley et al., U.S. Pat. No. 4,452,447, issued Jun. 5, 1984; Troxel, U.S. Pat. No. 4,605,220, issued Aug. 12, 1986; Stodgell, U.S. Pat. No. 5,368,536, issued Nov. 29, 1994; Bemardson, U.S. Pat. No. 5,851,166, issued Dec. 22, 1998; and Hayden, U.S. Pat. No. 6,277,057, issued Aug. 21, 2001. With these exercisers, the foot is secured on a platform and then moves the platform along a controlled path. None of these exercisers require the user to maintain balance and none of them are useful for assessing and improving proprioception.

A variety of products to improve a user's sense of balance are also known. O.E.M. Medical of Carlsbad, Calif. produces the K.A.T 550 and 3000 machines that feature an inflatable bladder upon which the users stands. Another balancing device is the Wobble Board, a platform mounted upon a downwardly-extending hemispherical member. These products are reactive in the sense that the user controls the movement. Neither of these devices enables the platform to be tilted so that the user is required to respond accordingly.

U.S. Pat. No. 5,755,652 issued May 26, 1998 to Gardner discloses an exercise apparatus having a tilting platform mounted upon two wedge-shaped parts that rotate relative to each other and relative to the platform. Movement from one direction of tilting to another direction requires a clockwise or counterclockwise sweep of the platform. For example, the Gardner machine cannot directly tilt front to back or side to side. Furthermore, rapid changes in tilting are not possible because of the time required for the wedge-shaped parts to rotate. And finally, random movement of the platform requires one of the wedge-shaped parts to be connected to and then rapidly disconnected from the other wedge-shaped part.

Accordingly, there is a demand for an improved machine for assessing and improving a user's proprioception. In particular, there is a demand for an improved machine that tilts a platform upon which a user stands and requires the user to maintain balance upon it.

SUMMARY OF THE INVENTION

One general object of this invention is to provide an improved machine for assessing and improving a user's proprioception. Another general object of this invention is to provide an improved method for assessing and improving a user's proprioception.

We have invented a proactive machine for assessing and improving a user's proprioception. The machine comprises: (a) a tilting platform upon which the user stands; (b) a non-rotating tilting means connected to the platform for tilting the platform along a first axis and along a second axis perpendicular to the first axis; and (c) a control means for controlling the tilting means. The user's proprioception can be assessed and improved by balancing on the platform as the platform is tilted.

We have also invented a method for assessing and improving a user's proprioception. The method comprises: (a) obtaining a proactive machine comprising a tilting platform upon which the user stands, a non-rotating tilting means connected to the platform for tilting the platform along a first axis and along a second axis perpendicular to the first axis, and a control means for controlling the tilting means; (b) placing the user on the machine; and (c) tilting the platform while the user reacts to maintain balance.

The proactive proprioception machine of this invention contains a platform that tilts in any direction and that can rapidly and directly move from one direction to another direction. The use of this machine provides a much improved method for assessing and improving a person's proprioception.

DETAILED DESCRIPTION OF THE INVENTION

Figure 1:
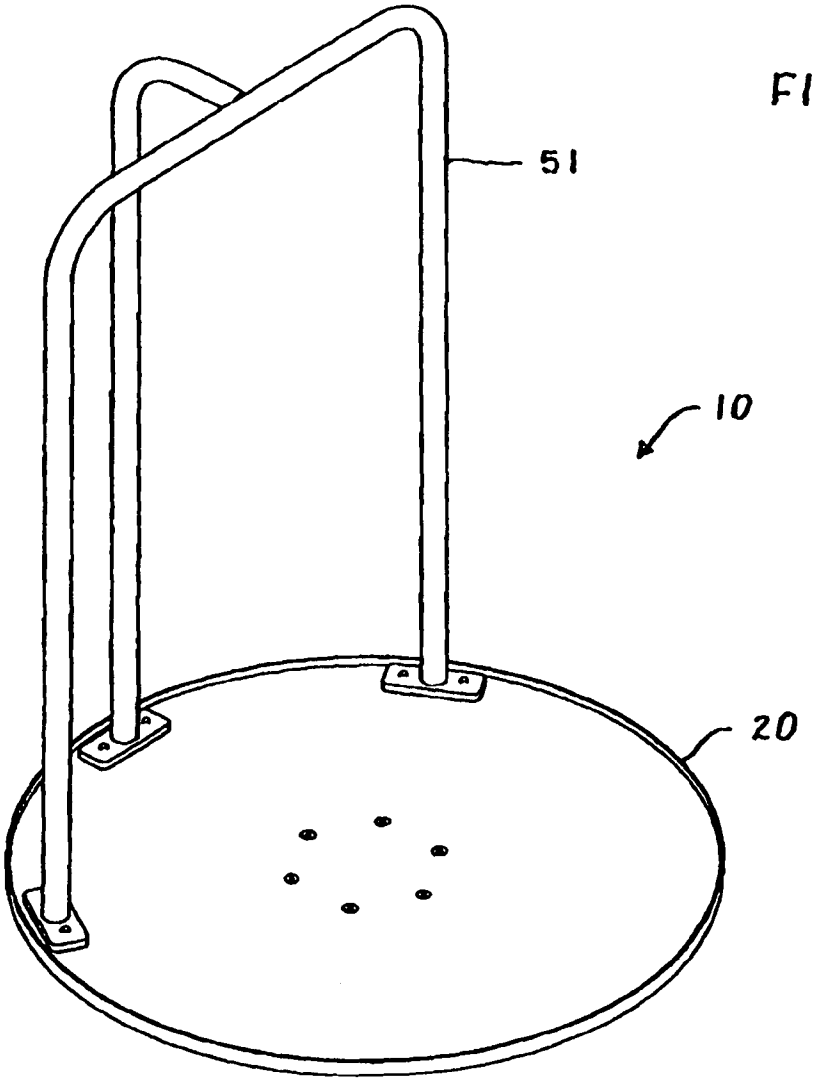
FIG. 1 is a top perspective view of a first preferred embodiment of the proprioception machine of this invention.
Figure 2:
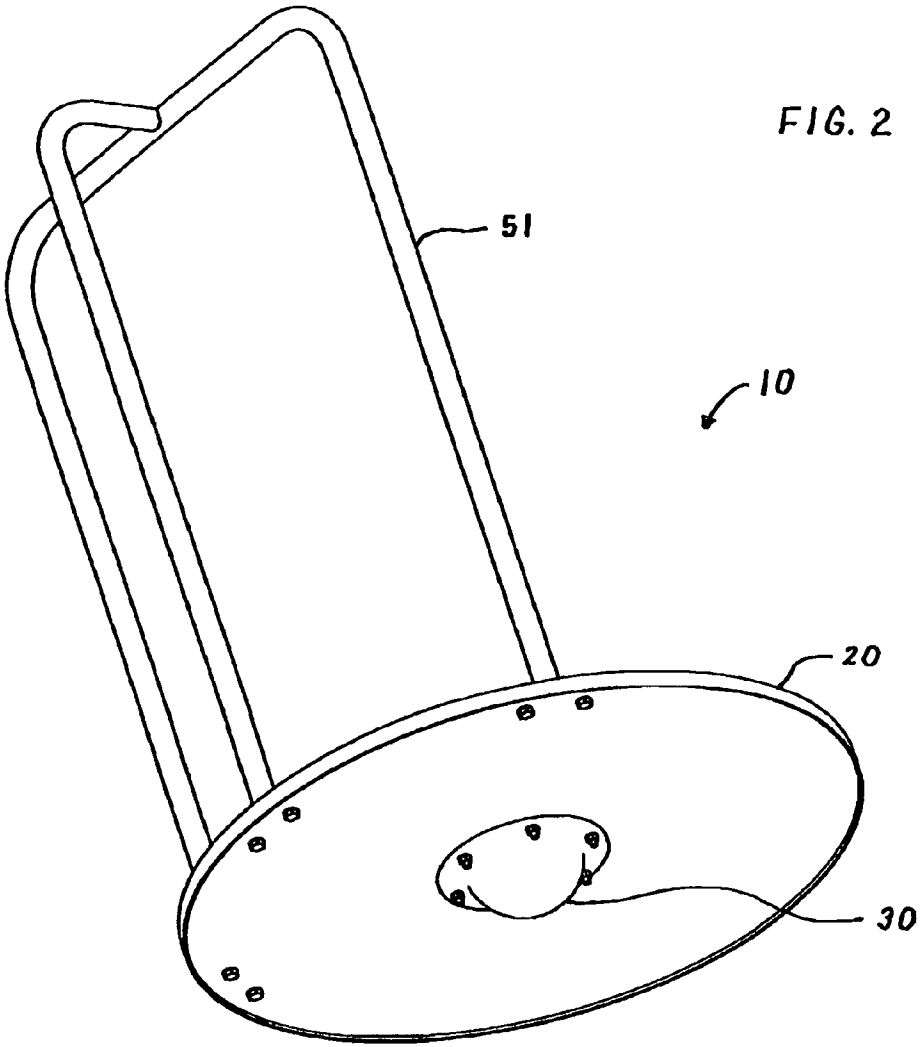
FIG. 2 is a bottom perspective view thereof.
Figure 3:
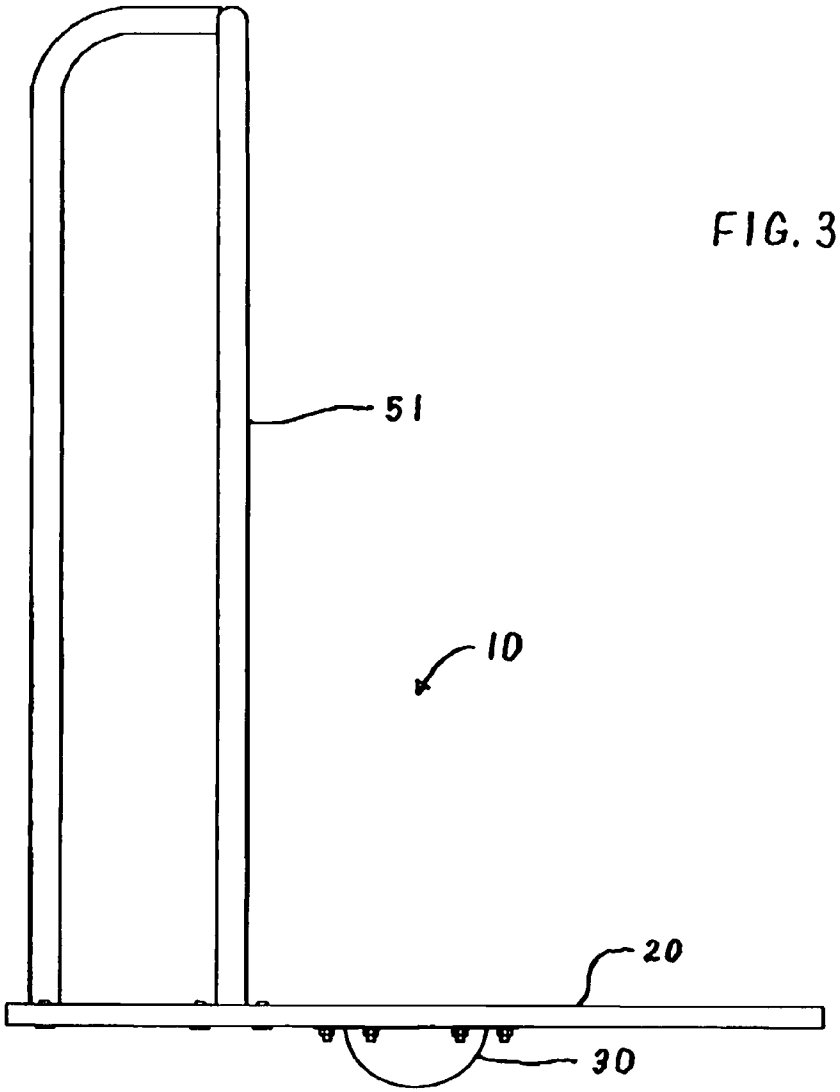
FIG. 3 is a side elevation view thereof.
Figure 4:
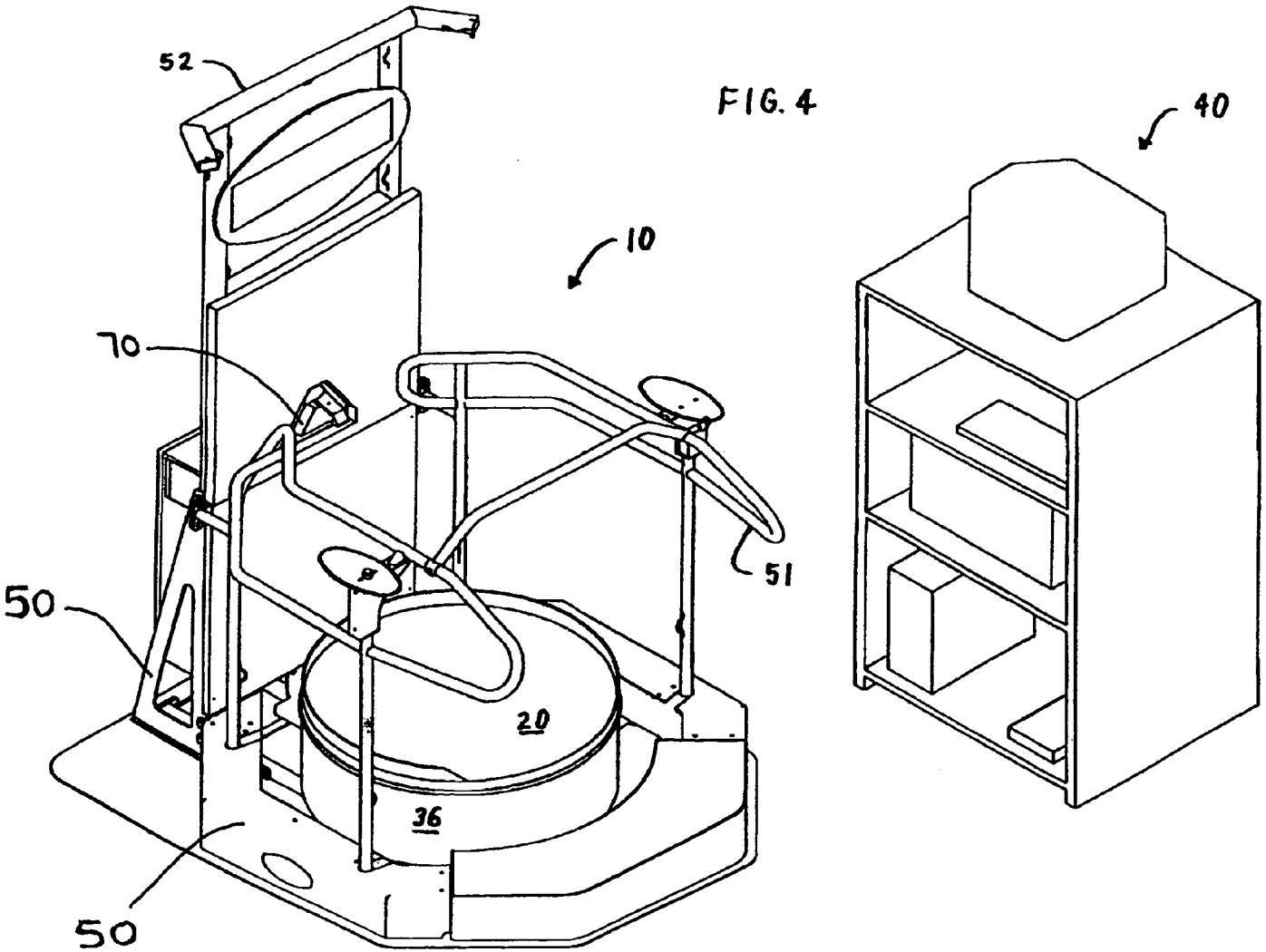
FIG. 4 is a top perspective view of a second preferred embodiment of the proprioception machine of this invention.
Figure 5:
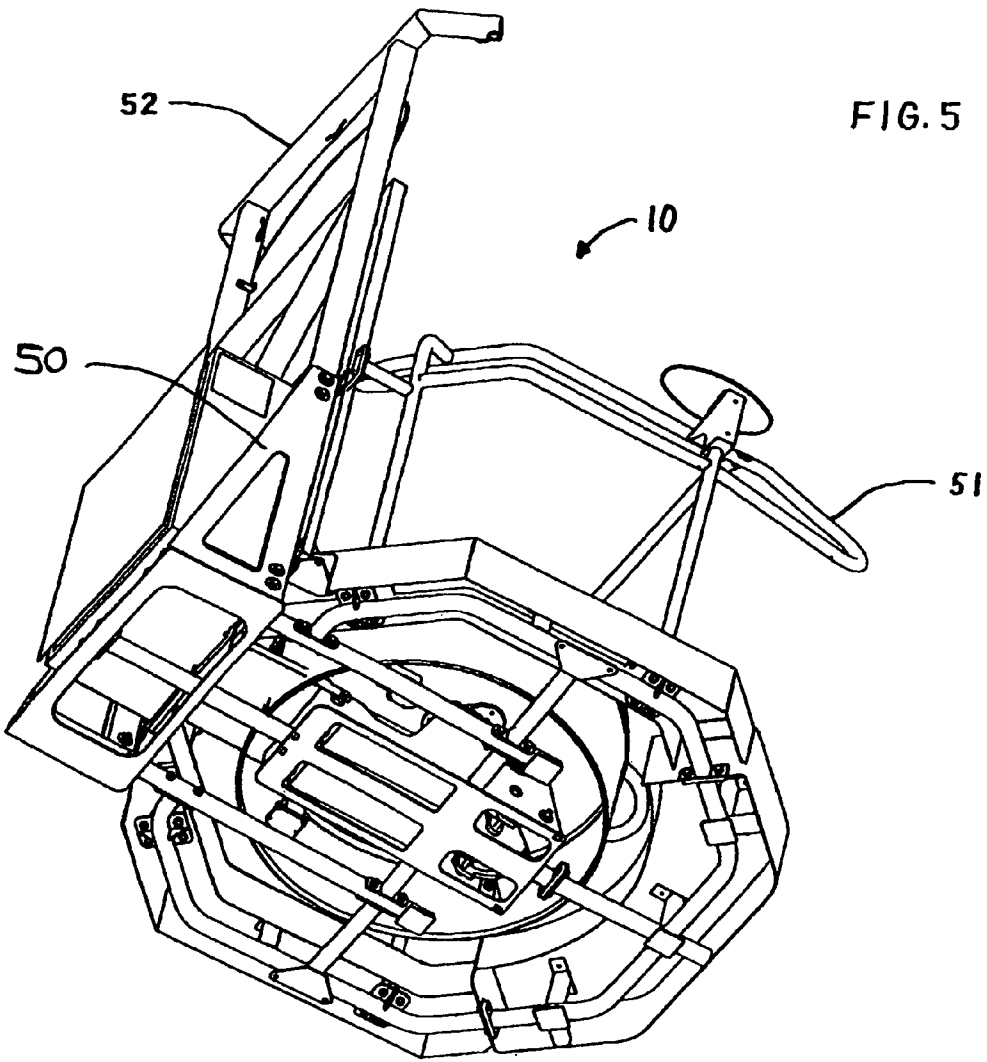
FIG. 5 is bottom perspective view thereof.
Figure 6:
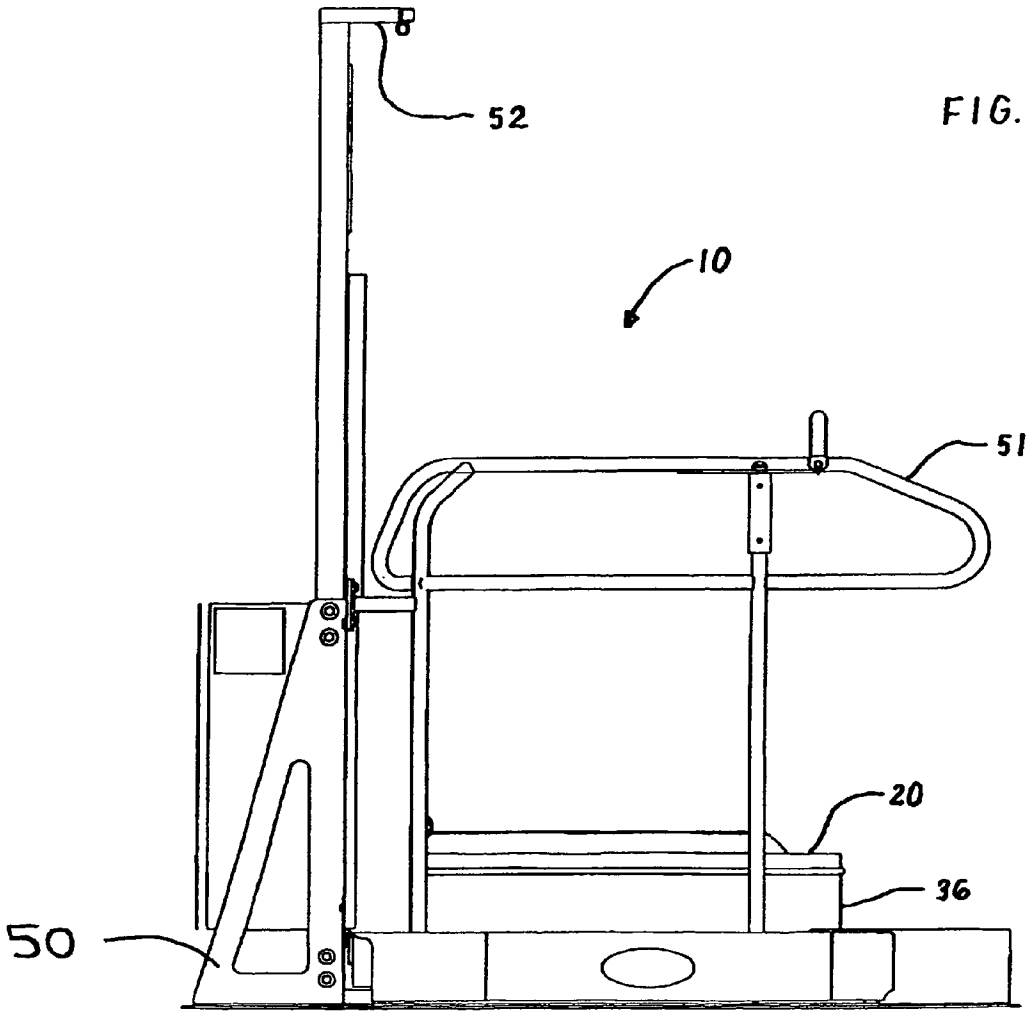
FIG. 6 is side elevation view thereof.
Figure 7:
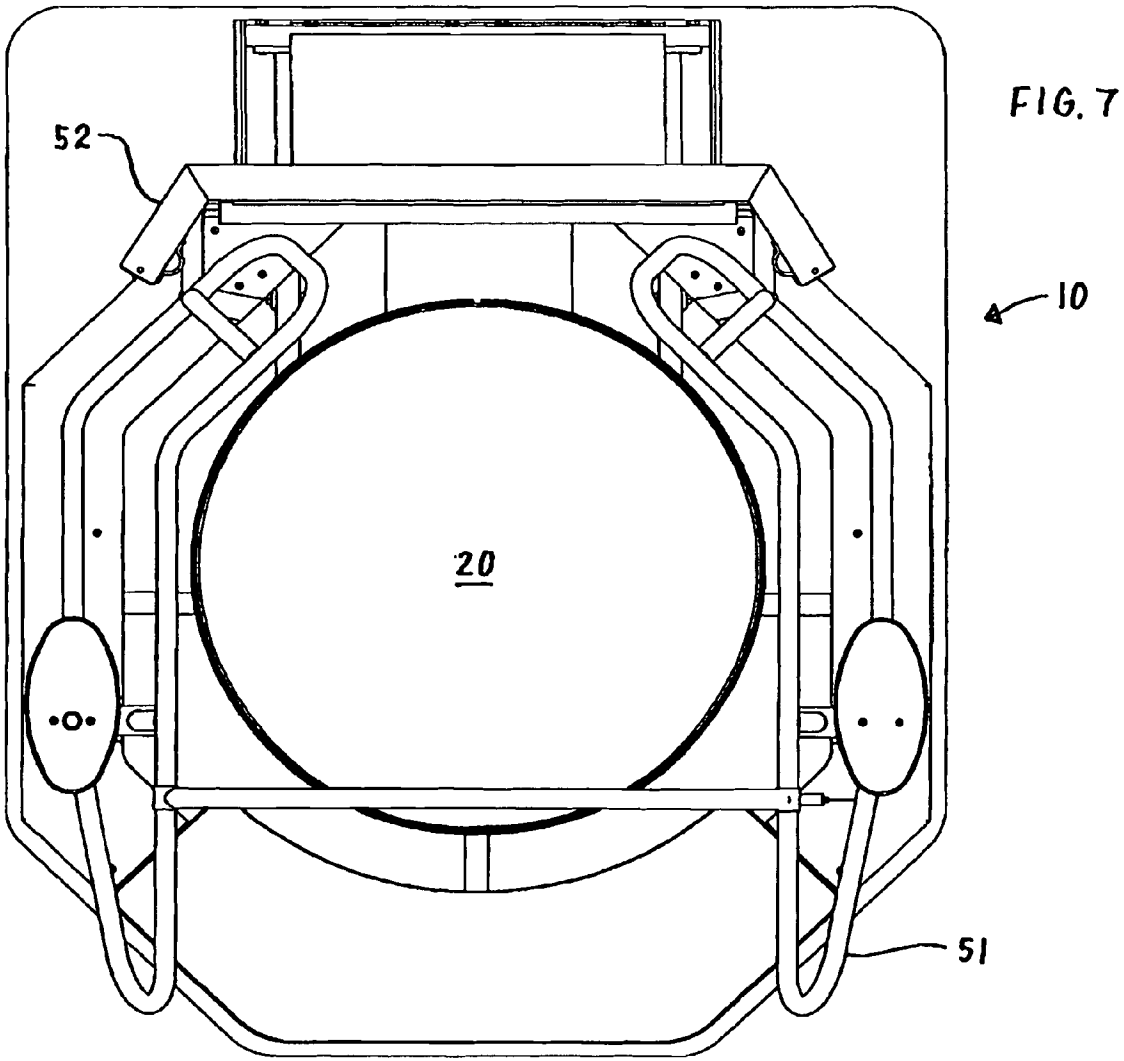
FIG. 7 is a top plan view thereof.

This invention is best understood by reference to the drawings. Referring to FIGS. 1 to 3, a first preferred embodiment of the proprioception machine 10 contains a tilting platform 20 upon which the user stands. The term "machine" is used synonymously with "apparatus" or "device" and does not connote or require the presence of parts that move relative to each other or the presence of a power source such as a motor, engine, or the like. The shape of the platform is not critical, but is preferably circular with a diameter of about one to four feet. The diameter is preferably about two to three feet so the user can stand on it with the feet at about shoulder width. The platform preferably contains a non-slip top surface.

The platform is supported by a tilting means 30 which, in this embodiment, consists of a downwardly-extending hemispherical member. The hemispherical member is non-rotating in the sense that it does not rotate relative to the platform. The hemispherical member is preferably a complete half of a sphere, but hemispheres less than a complete half of a sphere are also suitable. The size of the hemispherical member and the diameter of the platform combine to fix the maximum angle at which the platform can be tilted. In the preferred embodiment shown, the hemispherical member has a diameter of about nine inches, the platform has a diameter of about thirty inches, and the maximum tilting angle is about twenty degrees.

It can be seen that the tilting means enables the platform to be tilted along a first axis and to also be tilted along a second axis which is perpendicular to the first axis. The combination of tilting movement along both perpendicular axes produces a platform that tilts in any and all directions about a center pivot point. In other words, the movement of the platform is multi-planar and provides a full circumferential (360 degree) range of tilting. In still other words, the platform can tilt up or down from any point on its circumference when it is in the horizontal position.

The platform contains upwardly-extending handrails 51 which serve two purposes. Firstly, the handrails can be grabbed by the user of the machine if the user begins to lose balance. Secondly, the handrails are held by a human operator who manually pushes and pulls the handrails to tilt the platform front to back, side to side, or in any other direction as desired. The operator thus constitutes the control means. The operator is preferably a highly trained physical therapist or the like. It can be seen that the operator can directly tilt the platform from one position to any other position. It can also be seen that the operator can control the speed at which the platform changes position. The machine is proactive in that its platform is moved by the action of an outside force and requires the user to react to it.

Figure 8:
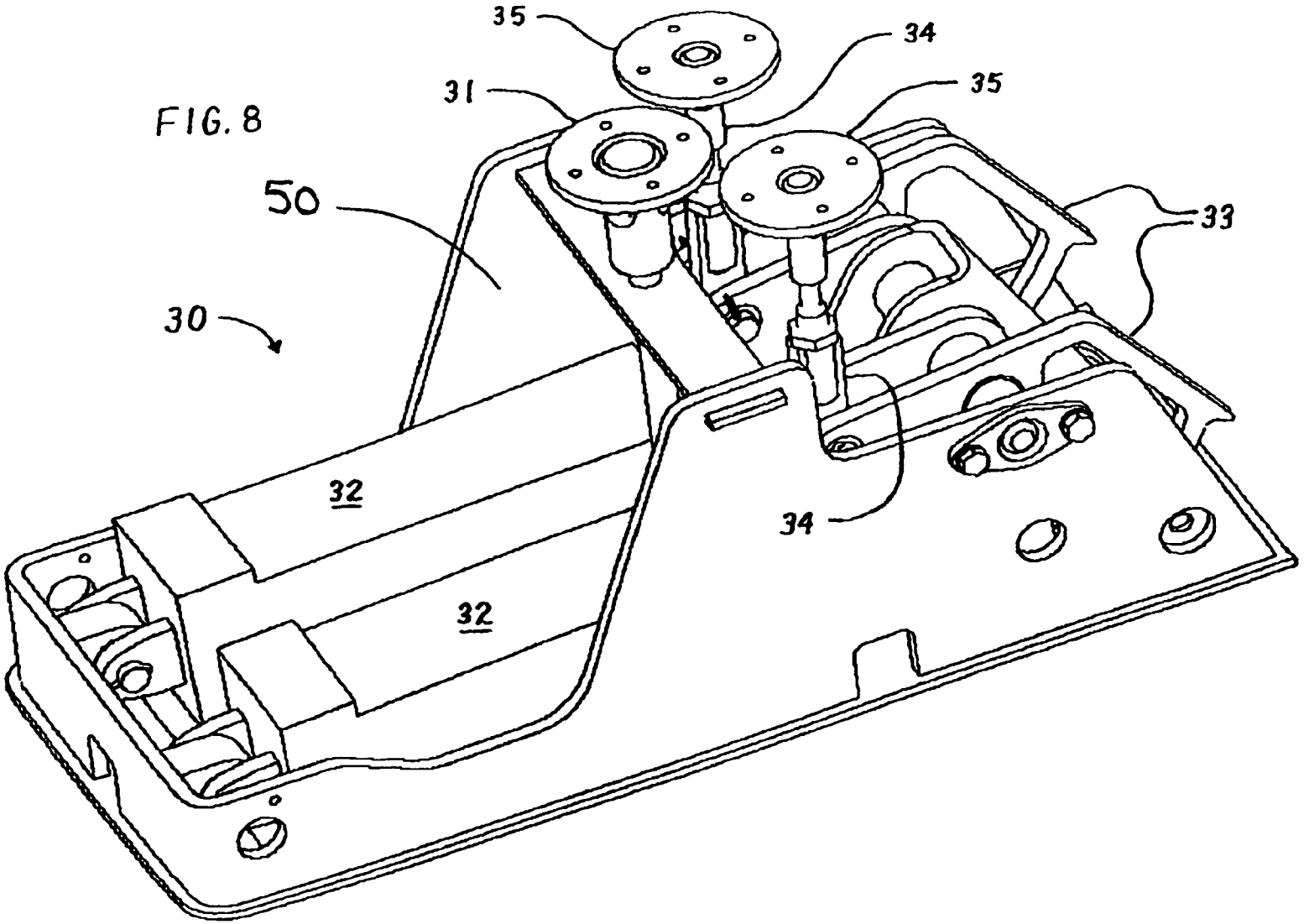
FIG. 8 is a detailed top perspective view of the tilting means thereof.
Figure 9:
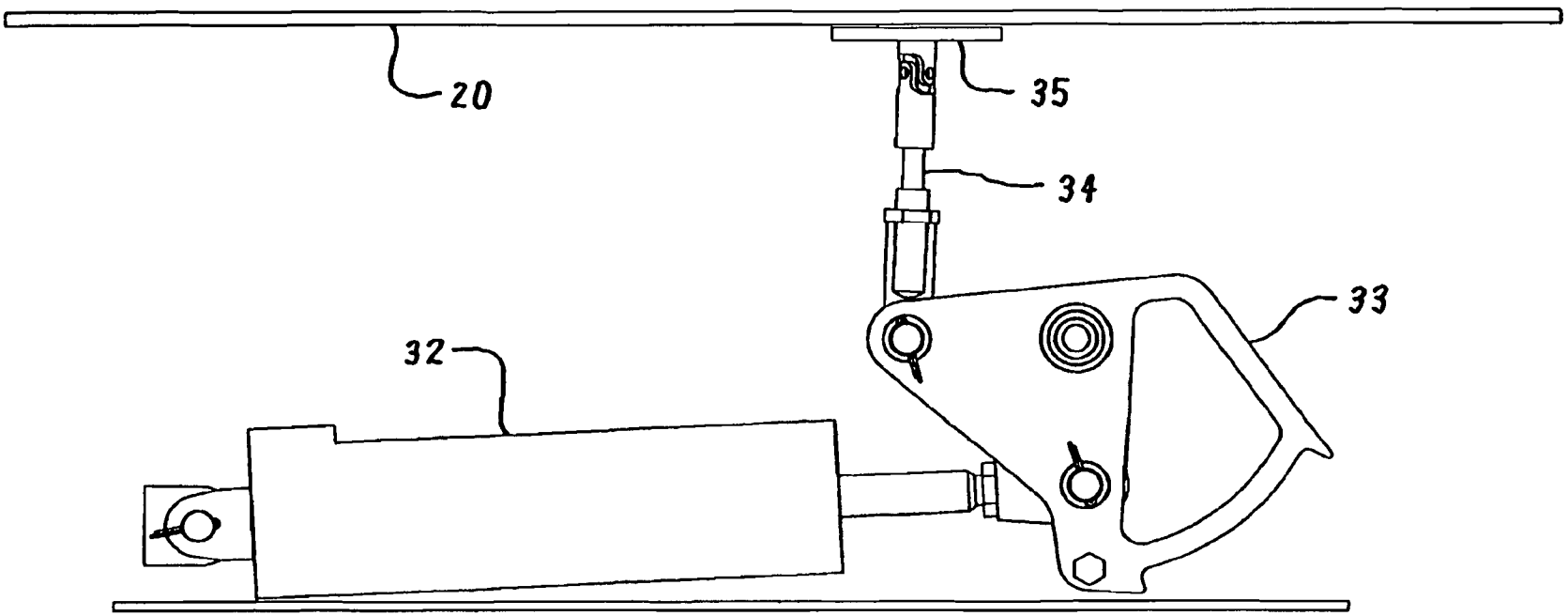
FIG. 9 is a detailed side elevation view of a portion of the tilting means thereof.

Referring now to FIGS. 4 to 7, a second preferred embodiment of the proprioception machine is similar to the first preferred embodiment except that both the tilting means and the control means are mechanized. In this preferred embodiment, the non-rotating tilting means includes a centrally-mounted ball joint 31 and two reciprocating actuators 32. A suitable reciprocating actuator is an Exlar Model SR41 linear actuator consisting of a servo-motor connected to a roller screw rod. Each actuator is connected to a pivoting member 33 that is, in turn, connected to a vertical support arm 34 that is attached to the lower surface of the platform with a universal mount 35. The reciprocating actuator, pivoting member, and vertical support arm are shown in detail in FIGS. 8 and 9.

The support arm connected to the first actuator is mounted on the first axis so that its movement causes the platform to move along the first axis, for example, from front to back. The support arm connected to the second actuator is mounted on the second axis so that its movement causes the platform to move along the second axis, for example, from side to side. The terms "front to back" and "side to side" are used to describe the fact that the two linear actuators provide movement on two perpendicular axes. The exact orientation of the perpendicular axes relative to the machine is not critical. For example, in the embodiment shown, the first actuator actually provides movement along an axis that runs from 45 to 225 degrees (when viewed from overhead) and the second actuator provides movement along an axis that runs from 135 to 315 degrees. Combining their motions enables the platform to tilt in any direction and to directly move from one position to any other position. The amount of the tilting is variable and is preferably limited to about twenty-five degrees from horizontal. If the angle of tilting exceeds this limit, it is very difficult for the user to maintain traction and balance. The speed at which the platform moves is variable. A bellows 36 is preferably attached between the platform and the base to cover the tilting means.

A variety of other reciprocating actuators are suitable for the tilting means, including those using hydraulic fluid, compressed air, or the like. For example, in place of the servo-motor linear actuators, the tilting means may include a first and a second hydraulic double-acting cylinder having a body trunion mount with a U-joint attachment to the lower surface of the platform. Proportional valves in the hydraulic lines provide variable speed and prevent platform drift if the power unit stops. The tilting means may also be connected to the side or the top of the platform if desired.

The tilting means is controlled by a control means 40. The control means includes a means for providing position feedback of each axis. In other words, the control means must be able to determine the tilt of the platform at any point in time. When servo-motor linear actuators are used, they can directly provide the position feedback. When other reciprocating actuators are used, separate encoders may be necessary. The control means also includes an operator-accessible interface, such as a computer with a monitor or touch screen, a control panel, or the like. If desired, the control means can also be made accessible to the user. The control means may include conventional dials, buttons, joystick, and processing unit. The control means preferably provides several types of controlled operation, including random, predictable (for example, inversion-eversion and dorsal flexion-plantar flexion), and joystick-controlled.

Surrounding the platform is a frame 50 including handrails 51, and an overhead support 52. During use of the machine, the user may occasionally lose balance. For this reason, a frame which reduces the chances of falls and injuries is highly advantageous. The user preferably wears a torso harness attached to the overhead support to reduce the chances of falling.

A means for measuring the spatial position of the user's hips (or other body part) along X, Y, and Z axes (front to back, side to side, and up and down) is also highly advantageous. While not wishing to be bound by theory, the displacement of a user's hips as the person is reacting to the movement of the platform is believed to be related to the person's proprioception. Displacement can be measured in a variety of ways, including ultrasonic transmitters 70 and receivers, and reel-type potentiometers that are connected from the frame to the user's hips. Thus, these objective measurements of physical parameters are believed to be related to proprioception.

Many other variations of the proprioception machine of this invention are possible. One variation includes a platform that contains two separate sections, one for each foot. This enables each section to be operated independently. A second variation includes the means to rotate the platform (and the tilting means) clockwise and counterclockwise as it is tilting. A third variation includes the means to raise and lower the platform as it is tilting. A raising and lowering variation would preferably contain three, rather than two, linear actuators and would omit the centrally-mounted ball joint.

As previously stated, the proprioception machine of this invention is proactive in that its platform moves by the action of an outside force and requires the user to react to it to maintain balance. This property gives the machine many uses. It is used for assessments, testing, diagnostics, rehabilitation, exercise, and injury prevention. It is also believed to improve a user's quickness. Accordingly, the machine is used by a wide range of people. One class of users is people who have suffered injuries. Another class of users is athletes who want to improve their proprioception (to reduce the chances of injury) and/or quickness, especially skiers, hockey players, soccer players, football players, basketball players, and the like.

While certain representative embodiments and details have been shown for the purpose of illustrating the subject invention, it will be apparent to those skilled in this art that various changes and modifications can be made therein without departing from the scope of the subject invention.

We claim:

1. A proactive machine for assessing and improving a user's proprioception, the machine comprising: (a) a tilting platform having a bottom and a top upon which the user stands; (b) a non-rotating tilting means connected to the platform for tilting the platform along a first axis and along a second axis, wherein said tilting means comprises a centrally-connected ball joint disposed underneath said platform, a first reciprocating actuator connected to said platform on said first axis and a second reciprocating actuator connected to said platform on said second axis; and (c) a control means for proactively controlling the tilting means; wherein the machine is adapted for the user to stand on the tilting platform, wherein the control means for controlling the tilting means causes the platform to tilt while the user stands on the tilting platform and reacts to maintain balance, and wherein the tilting platform tilts to an angle that does not exceed 25° from horizontal.

2. The machine of claim 1 additionally comprising a handrail.

3. The machine of claim 1 wherein the reciprocating actuators comprise servo-motor linear actuators.

4. The machine of claim 3 additionally comprising an overhead support for the user.

5. The machine of claim 4 additionally comprising a means for measuring movement of the user.

6. The machine of claim 1 wherein the tilting platform has a diameter of about 2 feet to about 3 feet.

7. The machine of claim 1 wherein the non-rotating tilting means can tilt the platform in any direction and wherein the non-rotating tilting means can directly move the platform to any tilted position.

8. A proactive machine for assessing and improving a user's proprioception, the machine comprising: (a) a tilting platform having a bottom and a top upon which the user stands; (b) a non-rotating tilting means connected to the platform for tilting the platform along a first axis and along a second axis, wherein said tilting means comprises a centrally-connected ball joint or universal joint disposed underneath said platform, a first reciprocating actuator connected to said platform on said first axis and a second reciprocating actuator connected to said platform on said second axis; and (c) a control means for proactively controlling the tilting means; wherein the machine is adapted for the user to stand on the tilting platform, wherein the control means for controlling the tilting means causes the platform to tilt while the user stands on the tilting platform and reacts to maintain balance, and wherein the tilting platform has a diameter of about 2 feet to about 3 feet.

9. The machine of claim 8 additionally comprising a handrail.

10. The machine of claim 8 wherein the reciprocating actuators comprise servo-motor linear actuators.

11. The machine of claim 10 additionally comprising an overhead support for the user.

12. The machine of claim 11 additionally comprising a means for measuring movement of the user.

13. The machine of claim 8 wherein the tilting platform tilts to an angle that does not exceed 25° from horizontal.

14. The machine of claim 8 wherein the non-rotating tilting means can tilt the platform in any direction and wherein the non-rotating tilting means can directly move the platform to any tilted position.

15. A method for assessing and improving a user's proprioception, the method comprising: (1) obtaining a proactive machine comprising: (a) a tilting platform having a bottom and a top upon which the user stands; (b) a non-rotating tilting means connected to the platform for tilting the platform along a first axis and along a second axis, wherein said tilting means comprises a centrally-connected ball joint or universal joint disposed underneath said platform, a first reciprocating actuator connected to said platform on said first axis and a second reciprocating actuator connected to said platform on said second axis; and (c) a control means for proactively controlling the tilting means; wherein the machine is adapted for the user to stand on the tilting platform, wherein the control means for controlling the tilting means causes the platform to tilt while the user stands on the tilting platform and reacts to maintain balance; (2) placing the user on the machine; and (3) tilting the platform while the user reacts to maintain balance; and wherein the tilting platform tilts to an angle that does not exceed 25° from horizontal.

16. The method of claim 15 wherein the machine additionally comprises a handrail.

17. The method of claim 15 wherein the reciprocating actuators of the machine comprise servo-motor linear actuators.

18. The method of claim 15 wherein the machine additionally comprises an overhead support for the user and wherein the user is connected to the overhead support.

19. The method of claim 15 wherein the machine additionally comprises a means for measuring movement of the user.

20. The method of claim 15 wherein the tilting platform has a diameter of about 2 feet to about 3 feet.

* * * * *